US005679632A

United States Patent [19]

Lee et al.

[11] Patent Number: 5,679,632

[45] Date of Patent: Oct. 21, 1997

[54] MOVIE FILM CLEANING SOLVENT COMPRISING N-PROPYLBROMIDE

[76] Inventors: Burnell Lee, 408 Warwick Dr., Naperville, Ill. 60565; Farah D. Azarnia, 5151 Hickory Ridge Blvd., Baton Rouge, La. 70817

[21] Appl. No.: 608,760

[22] Filed: Feb. 29, 1996

[51] Int. Cl.[6] ..... C11D 7/30; C11D 7/24; B08B 3/08

[52] U.S. Cl. ..... 510/412; 510/169; 134/42; 252/364

[58] Field of Search ..... 510/412, 169; 252/364; 134/42

[56] References Cited

U.S. PATENT DOCUMENTS

| | | | |
|---|---|---|---|
| 2,371,645 | 3/1945 | Aitchison et al. | 134/31 |
| 3,730,904 | 5/1973 | Clementson et al. | 252/171 |
| 3,773,677 | 11/1973 | Boyles | 252/172 |
| 4,056,403 | 11/1977 | Cramer et al. | 134/22 R |
| 4,107,077 | 8/1978 | Sullivan, Jr. et al. | 252/408 |
| 4,279,664 | 7/1981 | Figiel et al. | 134/38 |
| 4,652,389 | 3/1987 | Moll | 252/90 |
| 4,900,456 | 2/1990 | Ogilvy | 252/8.551 |
| 5,102,573 | 4/1992 | Han et al. | 252/153 |
| 5,190,678 | 3/1993 | Swartz et al. | 252/18 |
| 5,207,953 | 5/1993 | Thorssen et al. | 252/364 |
| 5,320,683 | 6/1994 | Samejima et al. | 134/40 |
| 5,403,507 | 4/1995 | Henry | 252/170 |
| 5,492,645 | 2/1996 | Oshima et al. | 510/412 |
| 5,616,549 | 4/1997 | Clark | 510/412 |

FOREIGN PATENT DOCUMENTS

| | | |
|---|---|---|
| 0609004 | 8/1994 | European Pat. Off. . |
| 6128591 | 5/1994 | Japan . |
| 7150197 | 6/1995 | Japan . |

OTHER PUBLICATIONS

Kirk–Othmer Encyclopedia Of Chemical Technology, "Blood, Coagulants and Anticoagulants to Cardiovascular Agents", Third Edition, vol. 4, (1978), John Wiley & Sons, Inc., New York, pp. 256, 257, 262 no month available.

NFPA 325—National Fire Protection Association, Inc., Guide to Fire Hazard Properties of Flammable Liquids, Gases, and Volatile Solids, 1994 Edition, prepared by the Technical Committee on Classification and Properties of Hazardous Chemical Data, pp. 325–1–325–94 no month available.

Abstract—Japanese Patent No. 03173835–A published Jul. 29, 1991, assigned to Asahi Glass, entitled "New stabilising (pseudo) azeotropic tri: cloro: di: fluoroethane composition useful as substitute freon and for heat transfer medium, foaming agent and precision instrument parts".

*Primary Examiner*—Christine Skane
*Attorney, Agent, or Firm*—Edgar E. Spielman, Jr.

[57] ABSTRACT

This invention relates to a solvent system and process for cleaning cellulose triacetate polymer camera film. The solvent system comprises n-propyl bromide and a mix of an alkyl bromide in which the alkyl group contains 4 to 7 carbon atoms and an alkane containing 6 to 7 carbon atoms.

12 Claims, No Drawings

MOVIE FILM CLEANING SOLVENT COMPRISING N-PROPYLBROMIDE

BACKGROUND OF THE INVENTION

This invention relates to an environmentally friendly solvent for use in cleaning movie film, in particular, cellulose triacetate film.

Movie film is designed for repetitive use and, as such, must be durable and true to its original shape and size over a long period of time. Curling, cracking or peeling of the film is not tolerable.

In addition, the film must be kept clean from skin oils, dust and other matter which can be deposited during film processing and handling. It is generally necessary to clean movie film several times during its life. Cleaning is conveniently done by immersing the film in a solvent which is contemporaneously subjected to sonication. The solvent is contained in a tank and the film is fed through the tank via film guides. The film is dried as it is removed from the tank and is rewound. The solvent must be capable of cleaning the film without leaving a deposit on the film and without causing any distortion or damage to the film. Heretofore, a preferred solvent has been 1,1,1-trichloroethane. However, this solvent is no longer favored as it is to soon be banned world-wide for solvent applications due to environmental concerns.

Environmental concerns could be attenuated if an alkyl bromide solvent could be used instead of 1,1,1-trichloroethane. This would be especially so if n-propyl bromide could be the solvent as it has good cleaning characteristics, a low boiling point and is environmentally friendly, e.g., its Ozone Depletion Potential is low as compared to 1,1,1-trichloroethane. The low boiling point is advantageous as it insures that there will be no or very little solvent residue left on the cleaned film. n-Propyl bromide was tried on several types of film and was found to be suitable except for films based on cellulose triacetate polymer. For this last type of film, the n-propyl bromide caused unacceptable curling. Despite this fatal infirmity, the benefits of using n-propyl bromide made it well worthwhile to investigate the problem and to search for a solution which would yield an n-propyl bromide based solvent which did not cause film curl but which still retained the benefits of n-propyl bromide.

THE INVENTION

This invention relates to an environmentally friendly solvent system suitable for use in cleaning cellulose triacetate polymer based camera film. The solvent systems of this invention comprise 40 to 75 wt. % n-propyl bromide product and 60 to 25 wt. % of a mix comprised of alkyl bromide in which the alkyl group contains 4 to 7 carbon atoms and an alkane containing 6 to 7 carbon atoms. The weight percentages are based upon the total weight of n-propyl bromide product and alkyl bromide in the solvent system.

The n-propyl bromide product used in the solvent systems of this invention can be pure n-propyl bromide or any of the commercially available products which are preferably of high purity, i.e., at least 98+wt. % n-propyl bromide. Lower purity product may be used, say 94 to 97 wt. % n-propyl bromide. The main impurity in most all cases is iso-propyl bromide. Iso-propyl bromide is a process impurity and its presence can be reduced by distillation. Thus, for the purposes of this invention, the term "n-propyl bromide product" is to mean pure n-propyl bromide or a product which contains n-propyl bromide and up to 6 wt. % normally occurring process impurities, the most prominent of which is often iso-propyl bromide. The most preferred n-propyl bromide product is that which is 99+wt. % pure n-propyl bromide. The weight percentages are based upon the total weight of the n-propyl bromide product.

One of the components present in the mix used in the solvent system of this invention is alkyl bromide in which the alkyl group contains 4 to 7 carbon atoms. Exemplary alkyl groups are: n-butyl, iso-butyl, n-pentyl, 2-methylbutyl, 3-methylbutyl, n-hexyl, 2,3-dimethyl butyl, n-heptyl and the like. Mixtures of any two or more of the alkyl bromides of this invention are suitable to serve as the alkyl bromide component. Preferred alkyl groups are the n-alkyl groups. It is preferred that the alkyl bromide be a primary bromide; however secondary and tertiary bromides are also suitable. Also preferred are those alkyl bromides having a boiling point within 20° C. of the boiling point of n-propyl bromide. The most preferred alkyl bromide is 1-bromo butane, i.e., n-butyl bromide.

The other component of the mix is an alkane containing 6 to 7 carbon atoms. Preferred are n-hexane, n-heptane or a mixture thereof. Most preferred is n-hexane, as it has a boiling point which approximates that of n-propyl bromide.

The mix preferably contains a 10 to 90 wt. % of one of the components with the balance being provided by the other component. More preferably, the mix contains 30 to 70 wt. % of one component and the balance being the other component. Most preferred are mixes containing 40 to 60 wt. % of one component with the balance being the other component. Particularly suitable are mixes containing from about 40 to 60 wt. % n-butyl bromide and 40 to 60 wt. % n-hexane, n-heptane or a mix thereof, with n-hexane being most desired.

The respective amounts of n-propyl bromide product and mix of alkyl bromide and alkane is, as before noted, about 40 to about 75 wt. % n-propyl bromide product and about 60 to about 25 wt. % mix. Preferably, the n-propyl bromide product is present in an amount of about 50 to about 70 wt. %, with the mix being present in an amount of about 50 to about 30 wt. %. Especially preferred are 50/50 and 66/34 blends of n-propyl bromide product to mix. The weight percents are based on the total amount of n-propyl bromide product and mix present in the solvent system.

The n-propyl bromide product and the mix and its components are highly miscible one with the other and, thus, they can be conventionally mixed together in any order with no particular requirements being needed.

The solvent systems of this invention can include additional constituents. For example, the n-propyl bromide can be stabilized against decomposition should it come in contact with a metal such as magnesium, titanium, steel or aluminum. These metals can act as catalysts which dehydrobrominate the n-propyl bromide. The dehydrobromination product is HBr which can, in turn, attack metal and leave it corroded.

Generally, any of the conventional stabilizers which are taught by the art to be useful in stabilizing halogenated hydrocarbon solvents are suitable for use in this invention, the only caveat being that the stabilizer not adversely affect the film to be cleaned. The stabilizer may be a singular stabilizer or a combination of stabilizers. The stabilizers can be nitroalkanes, ethers, epoxides, amines or any combination thereof. Preferred are the epoxides.

Some art recognized nitroalkanes are nitromethane, nitroethane, 1-nitropropane, 2-nitropropane and nitrobenzene. Preferred is nitromethane. They are usable either singularly or in form of a mixture of two or more.

The ethers include 1,2-dimethyoxyethane, 1,4-dioxane, 1,3-dioxolane, diethyl ether, diisopropyl ether, dibutyl ether, trioxane, alkyl cellosolves in which the alkyl group has 1 to 10 carbon atoms such as methyl cellosolve, ethyl cellosolve and iso-propyl cellosolve, acetal, acetone dimethyl acetal, 2,2-dimethoxypopane, diethoxymethane, acetaldehyde dimethyl acetal, dimethoxymethane, γ-butyrolactone, methyl t-butyl ether, tetrahydrofuran and N-methylpyrrole, They are usable either singularly or in the form of a mixture of two or more.

The epoxides include epichlorohydrin, propylene oxide, butylene oxide, cyclohexene oxide, glycidyl methyl ether, glycidyl methacrylate, pentene oxide, cyclopentene oxide and cyclohexene oxide. Preferred is 1,2-epoxybutane. They are usable either singularly or in the form of a mixture of two or more.

The amines include hexylamine, octylamine, 2-ethylhexylamine, dodecylamine, ethylbutylamine, hexylmethylamine, butyloctylamine, dibutylamine, octadecylmethylamine, triethylamine, tributylamine, diethyloctylamine, tetradecyldimethylamine, diisobutylamine, diisopropylamine, pentylamine, N-methylmorpholine, iso-propylamine, cyclohexylamine, butylamine, isobutylamine, dipropylamine, 2,2,2,6-tetramethylpiperidine, N,N-diallyl-p-phenylenediamine, diallyamine, aniline, ethylenediamine, propylenediamine, diethylenetriamine, tetraethylenepentamine, benzylamine, dibenzylamine, diphenylamine and diethylhydroxyamine. They are usable either singularly or in the form of a mixture of two or more.

A preferred stabilizer is 1,2-butylene oxide.

The amount of stabilizer used can be the conventional amount, e.g., from about 0.1 wt. % to 15 wt. %, with the weight percent being based upon the total weight of the n-propyl bromide product in the solvent. A most preferred stabilizer amount is 0.25–1.0 wt. % 1,2-butylene oxide. The weight percent is based upon the total weight of the solvent system.

The solvent system of this invention is used conventionally and could be seen as a suitable replacement for 1,1,1-trichloroethane. The solvent system is kept at a bath temperature within the range of from about 20° to about 45° C. The residency time for the film in the bath is conventional, say 0.1 to 5 seconds. The film drying temperature is about 25° to 35° C.

The cellulose triacetate polymer based camera films discussed herein are available from Eastman Kodak Company. These camera films are used in movie cameras.

EXAMPLES

A solvent system bath at room temperature was prepared in a vessel. Into the bath was immersed processed Eastman Kodak Company color negative camera film. The film was a cellulose triacetate polymer based film. The immersion lasted for 10 minutes. The film was removed and dried at room temperature. The dried film was then examined for curling, cracking and peeling. The following Table gives the results obtained.

TABLE

| Solvent System | Curling | Cracking | Peeling | Discoloration* |
|---|---|---|---|---|
| 1,1,1-TCE | none | none | none | none |
| 99 wt % NPB | slight curl | none | none | none |
| 50 wt % NPB | none | none | none | none |
| 25 wt % HEX | | | | |
| 25 wt% NBB | | | | |

*discoloration of the solvent system
TCE — trichloroethane
NPB — n-propyl bromide
NBB — n-butyl bromide
HEX — hexane.

We claim:

1. A solvent system comprised of 40 to 75 wt. % n-propyl bromide product and 60 to 25 wt. % of a mix comprised of alkyl bromide in which the alkyl group contains 4 to 7 carbon atoms and an alkane containing 6 to 7 carbon atoms, wherein the n-propyl bromide product comprises at least 94 wt. % n-propyl bromide.

2. The solvent system of claim 1 wherein the n-propyl bromide product is present in an amount of from 50 to about 70 wt. % and wherein the mix is present in an amount of from about 50 to about 30 wt. %.

3. The solvent system of claim 1 wherein the alkyl bromide is n-butyl bromide and the alkane is n-hexane.

4. The solvent system of claim 2 wherein the alkyl bromide is n-butyl bromide and the alkane is n-hexane.

5. The solvent system of claim 1 wherein the alkyl bromide is n-butyl bromide and the alkane is n-hexane and wherein the n-propyl bromide product is present in an amount of from about 50 to about 66 wt. % and wherein the mix is present in an amount of from about 50 to about 34 wt. %.

6. The solvent system of claim 1 wherein the mix contains from about 40 to 60 wt. % n-butyl bromide and 40 to 60 wt. % n-hexane, n-heptane or a mix thereof.

7. A process for cleaning cellulose triacetate polymer based camera film, which process comprises immersing the film into a solvent system comprised of from about 40 to about 75 wt. % of a n-propyl bromide product and from about 60 about to about 25 wt. % of a mix containing alkyl bromide in which the alkyl group contains 4 to 7 carbon atoms and an alkane containing 6 to 7 carbon atoms, wherein the n-propyl bromide product comprises at least 94 wt. % n-propyl bromide.

8. The process of claim 7 wherein the n-propyl bromide product is present in an amount of from 50 to about 70 wt. % and wherein the mix is present in an amount of from about 50 to about 30 wt. %.

9. The process of claim 7 wherein the alkyl bromide is n-butyl bromide and the alkane is hexane.

10. The process of claim 8 wherein the alkyl bromide is n-butyl bromide and the alkane is hexane.

11. The process of claim 7 wherein the alkyl bromide is n-butyl bromide, the alkane is hexane and wherein the n-propyl bromide product is present in an amount of from about 50 to about 66 wt. % and wherein the mix is present in an amount of from about 50 to about 34 wt. %.

12. The process of claim 7 wherein the mix contains from about 40 to 60 wt. % n-butyl bromide and 40 to 60 wt. % n-hexane, n-heptane or a mix thereof.

* * * * *

UNITED STATES PATENT AND TRADEMARK OFFICE

CERTIFICATE OF CORRECTION

PATENT NO. : 5,679,632

DATED : OCT. 21, 1997

INVENTOR(S) : BURNELL LEE and FARAH D. AZARNIA

It is certified that error appears in the above-identified patent and that said Letters Patent is hereby corrected as shown below:

On the title page: Item

[73] Assignee: Albemarle Corporation, Richmond VA

Signed and Sealed this

Twenty-eighth Day of April, 1998

Bruce Lehman

*Attest:*

BRUCE LEHMAN

*Attesting Officer*

*Commissioner of Patents and Trademarks*